US008578584B2

(12) United States Patent
Durocher et al.

(10) Patent No.: US 8,578,584 B2
(45) Date of Patent: Nov. 12, 2013

(54) METHOD FOR CENTERING ENGINE STRUCTURES

(71) Applicant: Pratt & Whitney Canada Corp., Longueuil (CA)

(72) Inventors: Eric Durocher, Vercheres (CA); John Pietrobon, Outremont (CA); Nicolas Grivas, Dollard des Ormeaux (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 0 days.

(21) Appl. No.: 13/655,860

(22) Filed: Oct. 19, 2012

(65) Prior Publication Data

US 2013/0061473 A1 Mar. 14, 2013

Related U.S. Application Data

(63) Continuation of application No. 12/571,952, filed on Oct. 1, 2009, now Pat. No. 8,316,523.

(51) Int. Cl.
*F01D 25/04* (2006.01)
*F01D 25/26* (2006.01)

(52) U.S. Cl.
USPC ..... 29/445; 29/889.2; 29/407.05; 29/407.1

(58) Field of Classification Search
USPC ..... 29/889.2, 898.07, 898.08, 407.05, 463, 29/445, 407.1; 415/253, 213.1, 134, 126, 415/220
See application file for complete search history.

(56) References Cited

U.S. PATENT DOCUMENTS

| | | | |
|---|---|---|---|
| 1,009,786 | A | 11/1911 | Pfeifer |
| 2,016,435 | A | 1/1931 | Isidin |
| 1,943,142 | A | 7/1932 | Peters |
| 2,621,850 | A | 12/1952 | Firth |
| 2,724,621 | A | 11/1955 | Kenney, Jr. |
| 2,860,015 | A | 11/1958 | Matterson |
| 2,941,781 | A | 6/1960 | Boyum |
| 3,261,587 | A | 7/1966 | Rowley |
| 3,398,306 | A | 8/1968 | Merrick et al. |
| 3,398,535 | A | 8/1968 | Campbell et al. |
| 3,421,686 | A | 1/1969 | Coplin et al. |
| 3,620,641 | A | 11/1971 | Keen et al. |
| 3,684,332 | A | 8/1972 | Benson et al. |
| 3,718,378 | A | 2/1973 | Clay |
| 4,035,044 | A | 7/1977 | Miyazaki |
| 4,093,321 | A | 6/1978 | Ikariishi et al. |
| 4,139,244 | A | 2/1979 | Guerguerian |
| 4,184,089 | A | 1/1980 | Sterrett et al. |
| 4,222,708 | A | 9/1980 | Davison |
| 4,276,974 | A | 7/1981 | Ladin |
| 4,330,234 | A | 5/1982 | Colley |
| 4,470,187 | A | 9/1984 | Klievoneit et al. |
| 4,501,095 | A | 2/1985 | Drinkuth et al. |
| 4,512,115 | A | 4/1985 | Miller |
| 4,548,546 | A | 10/1985 | Lardellier |
| 4,575,911 | A | 3/1986 | Laszlo |
| 4,987,736 | A | 1/1991 | Ciokajlo et al. |

(Continued)

*Primary Examiner* — David Bryant
*Assistant Examiner* — Jason L Vaughan
(74) *Attorney, Agent, or Firm* — Norton Rose Fulbright Canada LLP

(57) ABSTRACT

A method for centering an engine structure such as a bearing housing is provided which may be used, for example, during assembly of a mid turbine frame or other engine case structure. In one aspect, the method includes using spacers with respective radial spokes which connect inner and outer portions of the case. In another aspect, centering may be provided by machining selected contacting surfaces of selected components.

6 Claims, 10 Drawing Sheets

(56) References Cited

U.S. PATENT DOCUMENTS

| | | | |
|---|---|---|---|
| 5,001,830 | A | 3/1991 | Partington et al. |
| 5,160,251 | A | 11/1992 | Ciokajlo |
| 5,201,586 | A | 4/1993 | Zimmermann et al. |
| 5,326,222 | A | 7/1994 | Matyscak et al. |
| 5,625,446 | A | 4/1997 | Bedard |
| 5,642,011 | A | 6/1997 | Fanning et al. |
| 5,749,659 | A | 5/1998 | Nisley |
| 5,906,523 | A | 5/1999 | Thomson |
| 6,309,177 | B1 | 10/2001 | Swiderski et al. |
| 6,354,780 | B1 | 3/2002 | Davis et al. |
| 6,358,001 | B1 | 3/2002 | Bosel et al. |
| 6,942,390 | B2 | 9/2005 | Fuerst et al. |
| 6,956,367 | B2 | 10/2005 | Fujikawa et al. |
| 7,069,654 | B2 | 7/2006 | Robbins |
| 7,260,892 | B2 | 8/2007 | Schilling et al. |
| 7,273,348 | B2 | 9/2007 | Amirtharajah et al. |
| 7,501,811 | B2 | 3/2009 | Ono |
| 7,510,374 | B2 | 3/2009 | Meacham |

METHOD FOR CENTERING ENGINE STRUCTURES

CROSS-REFERENCE TO RELATED APPLICATIONS

This is a continuation of U.S. patent application Ser. No. 12/571,952 filed on Oct. 1, 2009.

TECHNICAL FIELD

The described subject matter relates generally to gas turbine engines and, more particularly, to an improved method for centering concentric cases or housings.

BACKGROUND OF THE ART

Assembly stack up may affect the concentricity of engine structures, such as the concentricity of the bearing housings with respect to the outer case of the gas turbine engine assembly, which could bring the turbine rotors off-center relative to stationary components such as turbine shrouds, thereby directly affecting the blade tip and secondary air seal clearance, among other things.

Accordingly, there is a need to provide an improved method for centering turbine engine cases.

SUMMARY

In one aspect, there is provided a method for positioning outer and inner cases of a gas turbine engine relative to one another, the outer and inner cases having a plurality of radial spokes extending between them when the outer and inner cases are assembled, a bearing housing being attached to the inner case, the method comprising: (1) determining a variance between a present spoke length and a desired spoke length for each spoke based on a desired positioning of the cases; wherein eccentricity is measured between the outer case and the bearing housing on a fixture assembly; (2) modifying an effective length of each spoke according to the variance to meet the desired spoke length; and then (3) assembling the cases with the spokes to provide the desired positioning of the cases.

In another aspect, there is provided a method for centering a bearing housing during a mid turbine frame assembly procedure, the mid turbine frame to be assembled including at least an inner case co-axially supported in an outer case by a plurality of radial spokes, and the bearing housing attached to the inner case, each of the spokes having an inner end abutting and connected to one of axial surfaces of the inner case, the method comprising: a) selecting one of the inner end of each spoke and each said axial surface to be machined for concentric adjustment of the bearing housing within the outer case before the respective spokes are connected to the inner case; b) measuring a radial distance D1 between the respective axial surfaces of the inner case and an inner diameter surface of the bearing housing when the respective inner ends of the spokes are selected to be machined; c) measuring a radial distance D2 between respective inner ends of the spokes and an inner diameter surface of the outer case when the respective axial surfaces are selected to be machined; d) machining the inner end of the individual spokes to suit the respective measurements taken in step (b), thereby obtaining a predetermined radial distance D between the inner diameter surface of the outer case and the inner diameter surface of the bearing housing when the mid turbine frame is assembled; or e) machining the respective axial surfaces of the inner case to suit the respective measurements taken in step (c), thereby obtaining a predetermined radial distance D between the inner diameter surface of the outer case and the inner diameter surface of the bearing housing when the mid turbine frame is assembled; and f) connecting the inner ends of the spokes to the axial surfaces of the inner case, respectively after step (d) or (e).

DESCRIPTION OF THE DRAWINGS

Reference is now made to the accompanying drawings depicting aspects of the described subject matter, in which.

DETAILED DESCRIPTION

Figure 1:
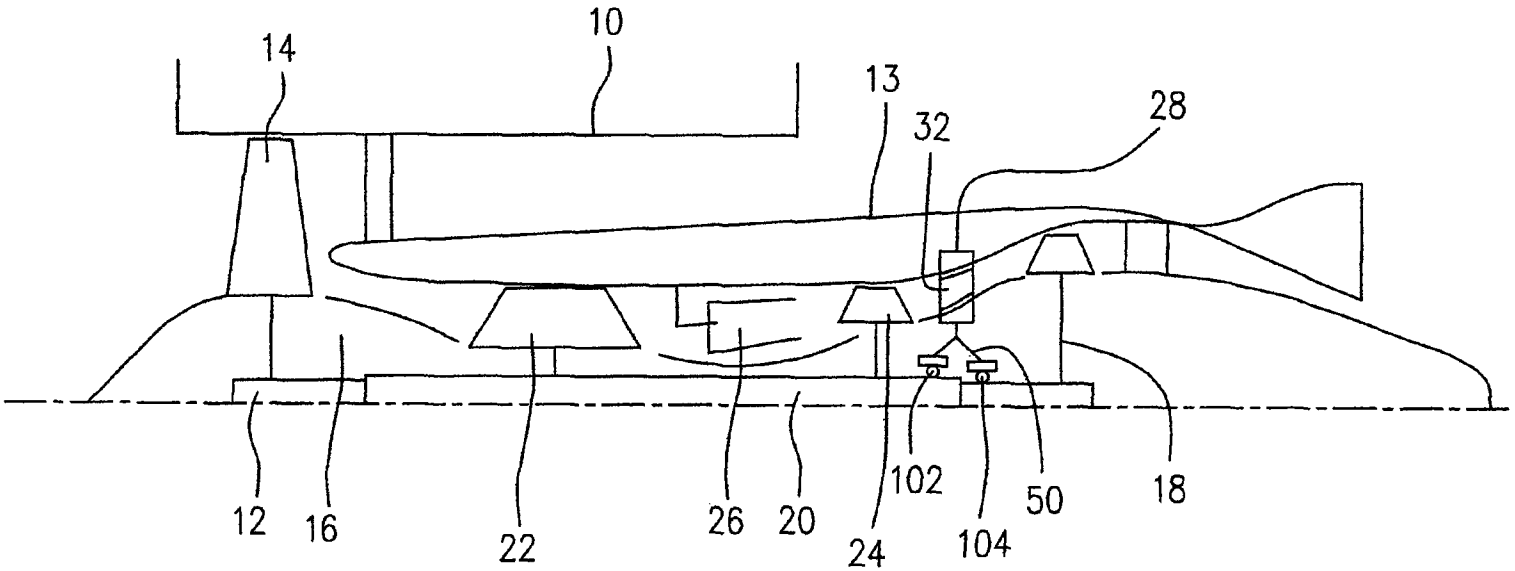
FIG. 1 is a schematic cross-sectional view of a turbofan gas turbine engine according to the present description.

Referring to FIG. 1, a turbofan gas turbine engine includes a fan case 10, an engine core case 13, a low pressure spool assembly which includes a fan assembly 14, a low pressure compressor assembly 16 and a low pressure turbine assembly 18 connected by a shaft 12, and a high pressure spool assembly which includes a high pressure compressor assembly 22 and a high pressure turbine assembly 24 connected by a turbine shaft 20. The core casing 13 surrounds the low and high pressure spool assemblies to define a main fluid path therethrough. In the main fluid path there is provided a combustor 26 to generate combustion gases to power the high pressure turbine assembly 24 and the low pressure turbine assembly 18. A portion of the core case 13 in this example engine, includes a mid turbine frame portion 28 disposed generally between the high pressure turbine assembly 24 and the low pressure turbine assembly 18 and supports a bearing housing 50 containing, for example, bearings 102 and 104 around the respective shafts 20 and 12. The terms "axial" and "radial" used for various components below are defined with respect to the main engine axis shown but not numbered in FIG. 1.

Referring to FIGS. 1-7, the mid turbine frame (MTF) portion 28 includes, for example, an annular outer case 30 which has mounting flanges (not numbered) at both ends with mounting holes therethrough (not shown), for connection to other components (not shown) which cooperate to provide the core casing 13 of the engine. The outer case 30 may thus be a part of the core casing 13. A spoke casing 32 includes an annular inner case 34 axially disposed within the outer case 30 and a plurality of load transfer spokes 36 (at least 3 spokes) radially extending between the outer case 30 and the inner case 34. The inner case 34 generally includes an annular axial wall 38 and an annular radial wall 33. The annular radial wall 33 is provided with an annular axial flange to define an inner diameter surface 37 which is concentric about an axis (not shown) of the inner case 34. The spoke casing 32 supports the bearing housing 50 (schematically shown in FIGS. 1 and 3), mounted thereto in a suitable fashion such as by fasteners (not numbered), which accommodates one or more main shafts bearing assemblies therein, such as bearing 102, and bearing 104. The bearing housing 50 is connected to the spoke casing 32 and is centered with the annular inner case 34 and rests on the inner diameter surface 37 of the inner case 34, thereby being centered with the annular inner case 34.

The MTF portion 28 may be further provided with inter-turbine duct structure 110 for directing combustion gases to flow through the MTF portion 28. The inner-turbine duct (ITD) structure 110 includes, for example, an annular duct 112 has an annular outer duct wall 114 and an annular inner duct wall 116. An annular path 136 is defined between the outer and inner duct walls 114, 116 to direct the combustion gas flow.

The annular duct 112 further includes a plurality of radially-extending hollow struts 118 (at least three struts) connected to the respective outer and inner duct walls. A plurality of openings 120, 122 are defined in the respective outer and inner duct walls 114, 116 and aligned with the respective hollow struts 118 to allow the respective load transfer spokes 36 to radially extend through the hollow struts 118.

The ITD structure 110 may include a retaining apparatus such as an expansion joint 138 (see FIG. 2) for supporting the ITD structure 110 within the outer case 30.

The load transfer spokes 36 are each connected at an inner end (not numbered) thereof, to the axial wall 38 of the inner case. For example, a flat end plate 52 which are substantially perpendicular to the spoke 36 and is connected to an axial surface of a connecting pad 35, which are substantially perpendicular to the spoke 36 connected thereto. The spokes 36 are each connected at an outer end (not numbered) thereof, to the outer case 30 by a plurality of fasteners 42. The fasteners 42 extend radially through openings 46 (see FIG. 5) defined in the outer case 30, and into holes (not numbered) defined in the outer end of the spoke 36.

The outer case 30 includes for example, a plurality of support bases 39, each being defined as a flat base substantially normal to a central axis (not shown) of the respective load transfer spokes 36. The support bases 39 are formed by a plurality of respective recesses 40 defined in the outer case 30. The recesses 40 are circumferentially spaced apart one from another corresponding to the annular position of the respective load transfer spokes 36. The outer case 30 in this embodiment has truncated conical configuration in which a diameter of a radial end of the outer case 30 is larger than a diameter of a front end of the outer case 30. Therefore, a depth of the support bases 39/recesses 40 varies, decreasing from the front end to the rear end of the outer case 30. An inner diameter surface 49 is circumferentially and axially defined in the front end of the outer case 30, which is concentric about the axis of the annular outer case 30. The inner case 34 is supported within the outer case by the plurality of the radial spokes 36. Due to tolerance stack up, the bearing housing 50 may not be concentrically positioned within the outer case 30 enough to meet engine assembly requirements.

It is noted that the concentricity of the outer and inner cases 30, 34 is affected by variance of the present spoke length and a desirable spoke length. Therefore, it is possible to modify an effective spoke length to meet the desired spoke length. The present spoke length is the actual length of the spoke 36. The effective spoke length is an actual radial distance effected by a spoke when the spoke is connected between the outer and inner cases 30, 34. The effective spoke length may be affected not only by the actual length of the spoke 36, but also other by factors such as spacers between the spoke and the connected cases or the position of mating surfaces of the cases which the spoke end abuts.

Referring to FIGS. 1-3 and 7, a method for centering the bearing housing 50 according to one embodiment is described. A sub-assembly (not numbered) of an MTF portion 28 includes at least the outer case 30 and the spokes 36 and may further include the ITD structure 110 positioned within and connected to the outer case 30 by the joint 138. The radial spokes 36 which, for example, are placed within the ITD structure 110 and inserted radially outwardly through the respective hollow struts 118 such that the outer end of the respective spokes 36 are received within the respective recesses 40 of the outer case 30 and a secured thereto by fasteners 42.

The inner case 34 is then placed within the above described sub-assembly and positioned concentric with respect to the outer case 30. The concentricity of the inner case 34 relative to the outer case 30 is assured by means of a fixture which is schematically shown by broken lines 130 which includes concentric annular positioning surfaces (not numbered) abutting the respective inner diameter surfaces 37, 49 of the inner and outer cases 34, 30, thereby holding the sub-assembly and the inner case 34 in a concentric position.

Due to the manufacturing accuracy and tolerance stack-up, a radial gap G1 (see FIG. 7) may exist between the flat end plate 52 of the respective spokes 36 and the axial surface of the connecting pads 35 attached on the axial wall 38 of the inner case 34. The respective gaps G1 may vary and are accurately measured, respectively. The measured result of each radial gap G1 is used to select one of a spacers, for example classified spacers 47 (see FIG. 7), which has a thickness following the measured result of the specific gap G1. The next step is to insert the selected spacers 47 into and thus close the respective gaps G1, and then the flat end plate 52 of the spokes 36 are secured to the respective axial surfaces of pads 35, for example, by fasteners (not shown) through mounting holes (not numbered) in the respective end plates 52 and the connecting pads 35 (see FIG. 2). The final step is to attach the bearing housing 50 to the inner case 34 and secure them together with, for example, bolts (not shown).

Figure 2:
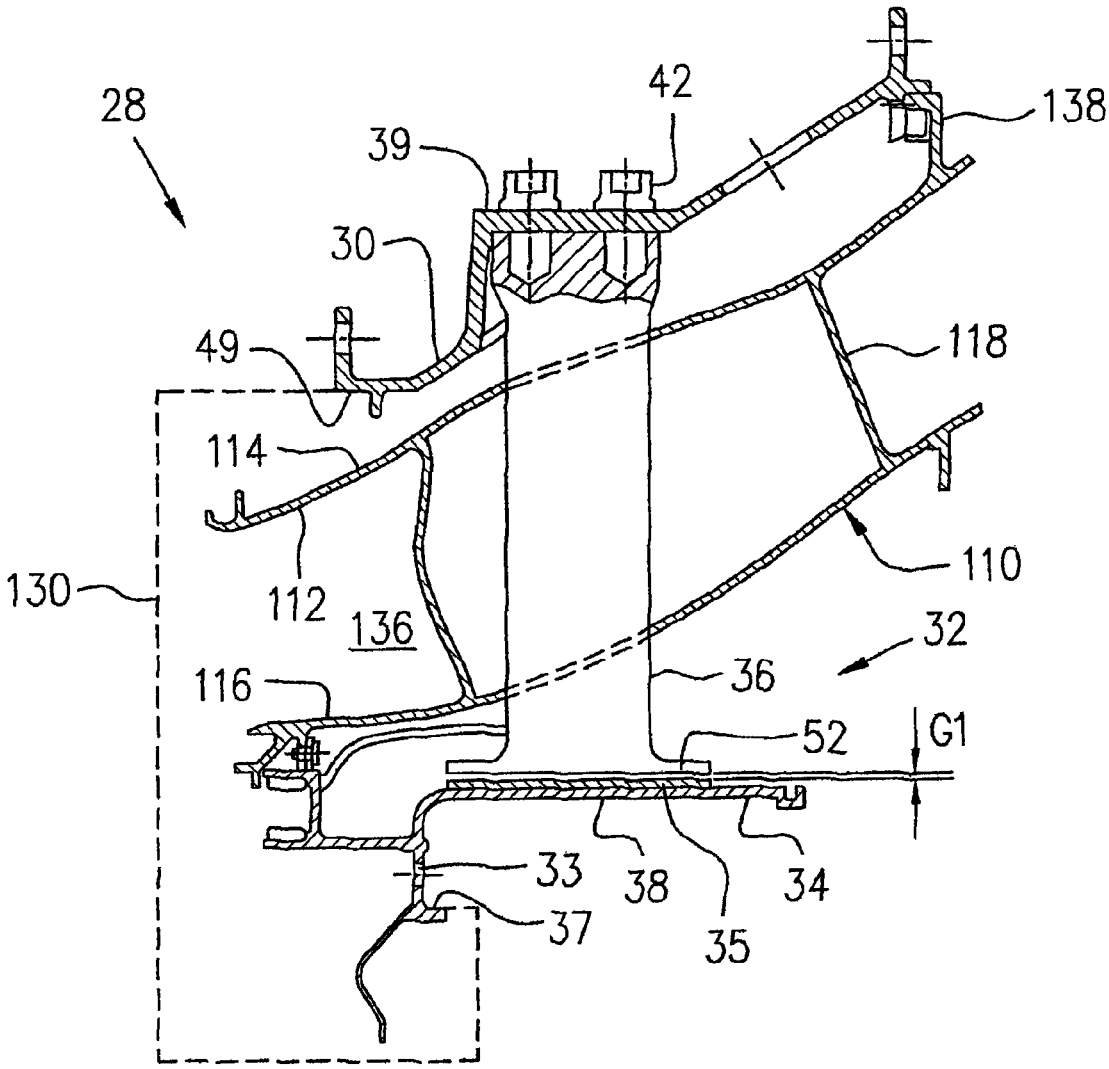
FIG. 2 is a partial cross-sectional view of the gas turbine engine of FIG. 1, showing a mid turbine frame thereof (with a bearing housing removed)
Figure 3:
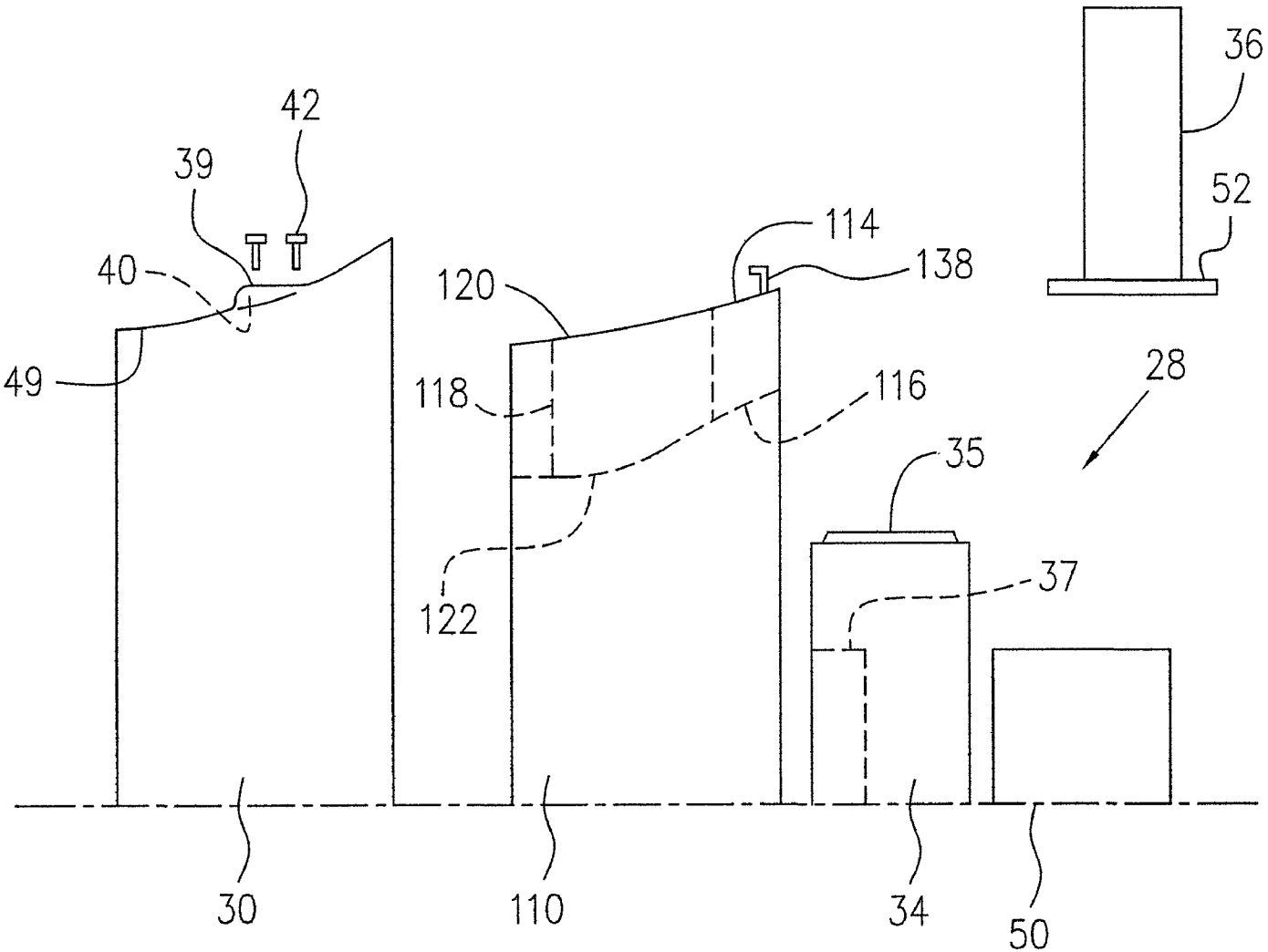
FIG. 3 is an exploded illustration schematically showing the mid turbine frame of FIG. 2 and a bearing housing to be attached thereto.
Figure 4:
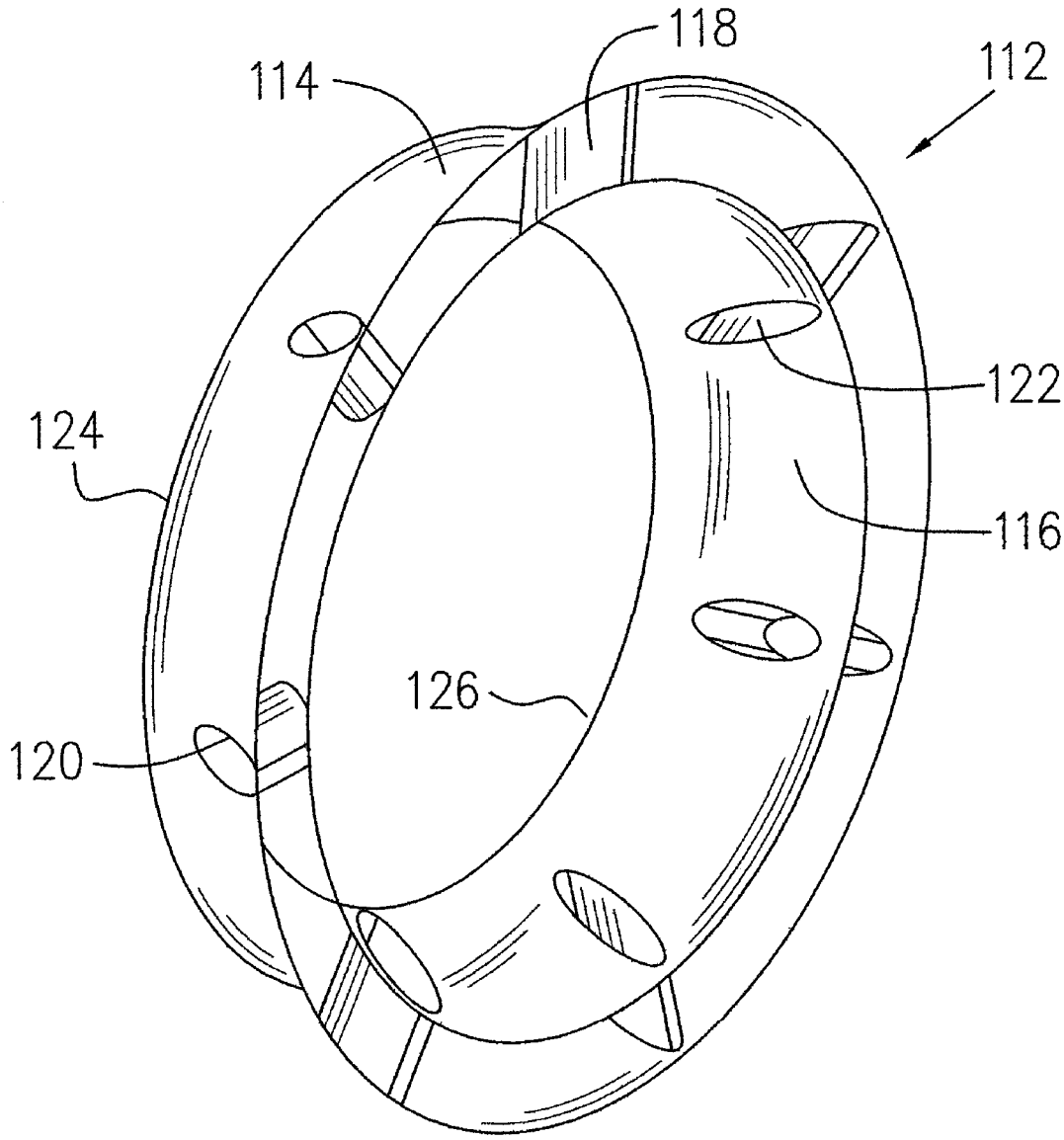
FIG. 4 is a perspective view of an inter turbine duct included in the mid turbine frame of FIG. 2.
Figure 5:
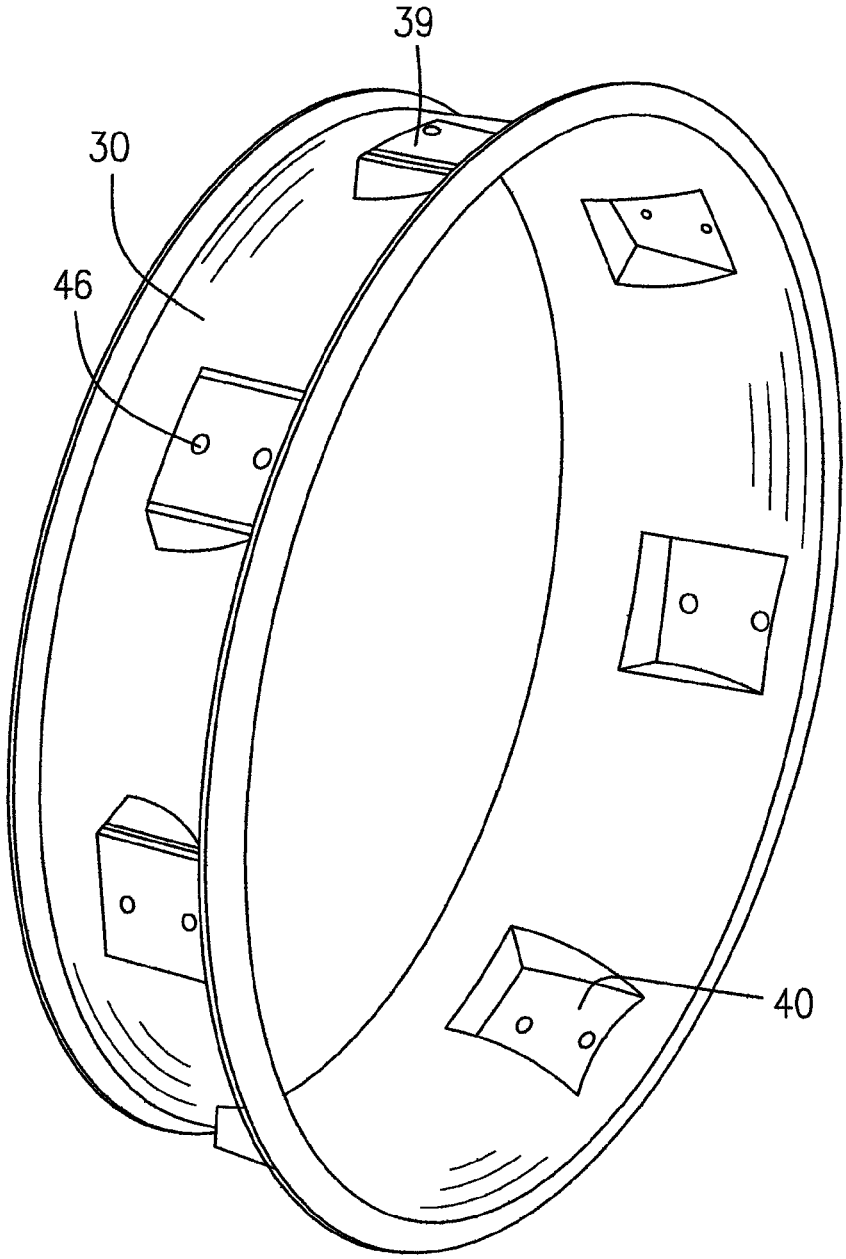
FIG. 5 is a perspective view of an outer case of the mid turbine frame of FIG. 2.
Figure 6:
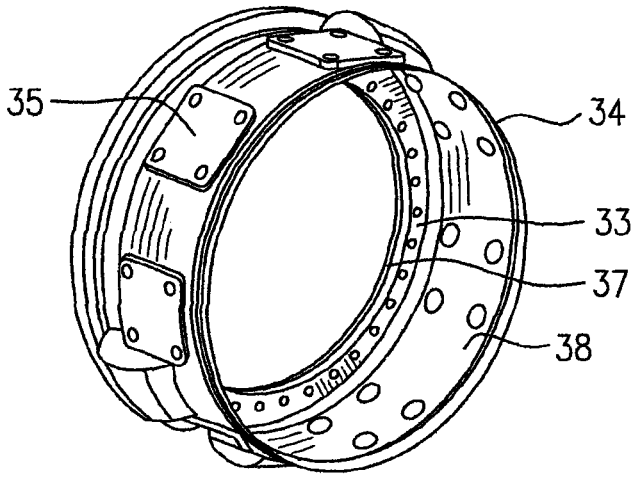
FIG. 6 is a perspective view of an inner case of the mid turbine frame of FIG. 2.
Figure 9:
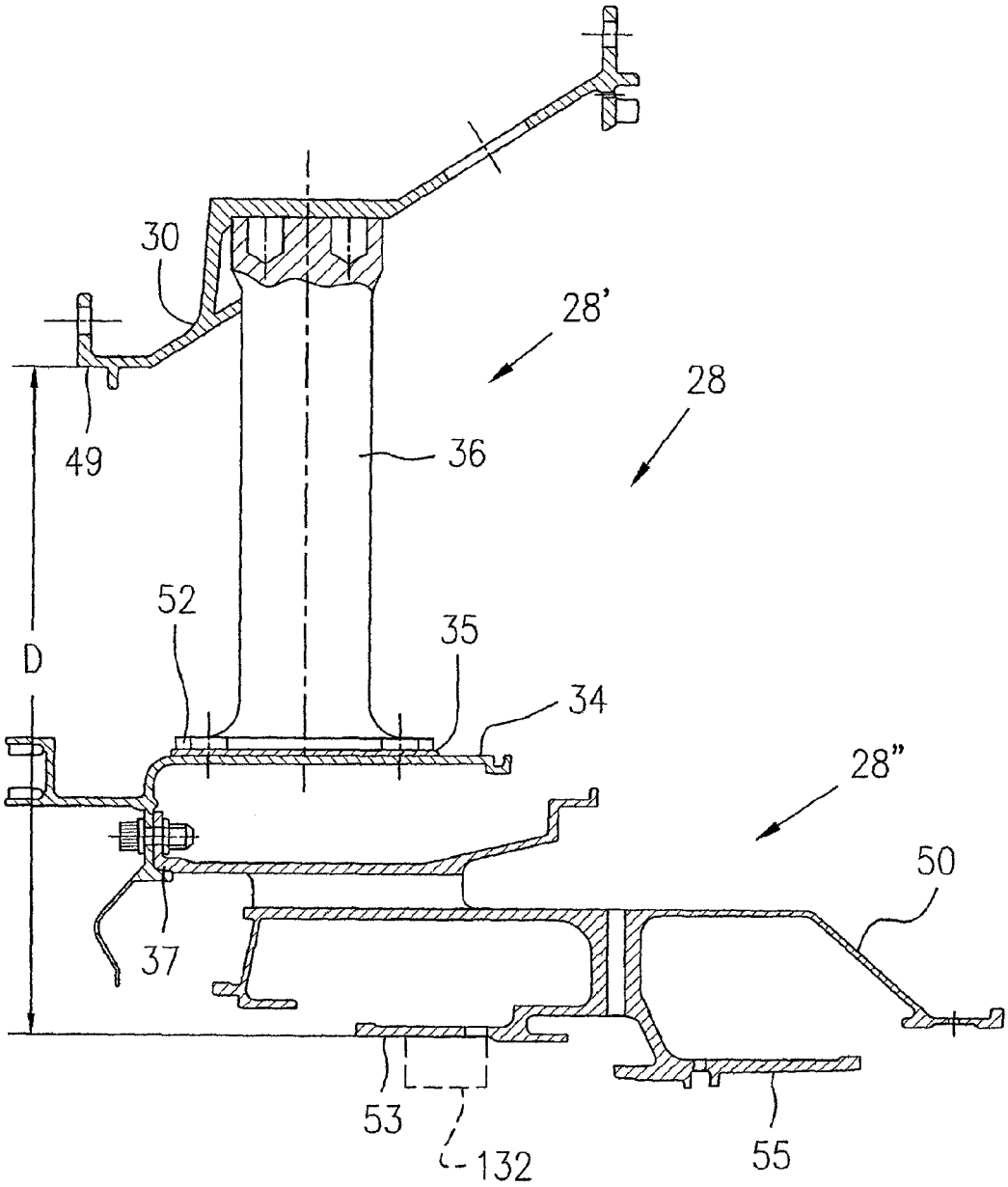
FIG. 9 is a cross-sectional view of a mid turbine frame of the engine of FIG. 1 according to another embodiment.

As referring to FIG. 9, the concentricity of the bearing housing 50 relative to the inner case 34 is assured by the abutment of the inner diameter surface 37 of the inner case 34 and an inner diameter surface (not numbered) of the bearing housing 50. The bearing housing 50 further defines, for example, an annular and axial inner diameter surface 53 and inner diameter surface 55 for receiving respective bearings 102, 104 (see FIG. 1). The not numbered inner diameter surface of the bearing housing 50 which abuts the inner diameter surface 37 of the inner case 34, is concentric relative to the inner diameter surfaces 53, 55 of the bearing housing 50, which is assured by the machining process of the bearing housing 50. It is noted that the fixture 130 shown in FIG. 2 is removed before the bearing housing 50 is attached to the inner case 34.

Alternatively, the bearing housing may be attached to the inner case 34 to form a second sub-assembly of the MTF portion 28 before the inner case 34 is connected to the respective spokes 36. In this alternative embodiment, the fixture 130 is replaced by a similar fixture (not shown) which contacts inner diameter surface 49 of the outer case 30 but does not contact the inner diameter surface 37 of the inner case 34 as shown in FIG. 2, instead, directly abuts one of the inner diameter surfaces 53, 55 of the bearing housing 50 (see FIG. 12), thereby centering the outer case 30 directly with respect to the bearing housing 50 for an even better centering result.

Referring to FIGS. 1, 3-6 and 8, a method for centering a bearing housing according to another embodiment is described. This method is similar to the method described with reference to FIG. 2, and only the difference is described.

According to this embodiment, the selected spacers 47 are not used to fill-up radial gaps between the inner end of the respective spokes and the inner case 34, but are used to close the radial gaps between the outer end of the respective spokes 36 and the outer case 30 when the respective spokes 36 are in direct contact with the inner case 34. In practice, a sub-assembly of the outer case 30, and spokes 36, optionally with ITD structure 110 is provided similarly with that in FIG. 2 except that the spokes 36 are temporarily attached to the outer case 30, for example by only one fastener 42. The sub-assembly and the inner case 34 are held in concentric position by the fixture 130. At this stage, the outer end of the respective spokes are disconnected from the outer case 30. The next step is to measure a radial gap G2 between the inner and outer end of each spoke 36 and the inner flat surface of each recess 40 of the outer case 30. During the measuring procedure of each radial Gap G2, it is assured that the related spoke 36 is radially inwardly restrained such that the inner end plate 52 of the spoke 36 is in direct contact with the axial surface of connecting pad 35 of the inner case 34.

After the respective spacers 47 are selected for the individual gaps G2, the inner case 34 may be removed from the fixture 130 to allow the respective spokes 36 to be moved away to allow the selected spacer 47 to be placed in position such that the spoke 36 can be moved back in position to be secured to the outer case 30 with the spacer sandwiched therebetween. At this stage, the inner case 34 may be moved back in position and the inner end plates 52 of the respective spokes 36 are secured to the respective connecting pads 35 of the inner case 34.

Similar to the embodiment shown in FIG. 2, the bearing housing 50 may be attached to the inner case 34 as a last step or alternatively, may be pre-connected to the inner case 34 as previously described. It is noted that in a pre-attached condition, the bearing housing 50 may be required to be removed during operation of securing the inner end plates 52 of the respective spokes 36 to the inner case 34 if room is required for placing or fastening the fasteners (not shown) in this operation.

It is also noted that an opening (not shown) may be required in the bases 39/recesses 40 for measuring the radial gaps G2.

Referring to FIGS. 1, 3-5, and 9-11, there is described a method for centering a bearing housing according to another embodiment. Instead of adjusting the different radial distances between the outer and inner cases by shimming the respective spokes as described with reference to FIGS. 2 and 8, the different radial distances according to this embodiment, are adjusted by actually machining the individual spokes or alternatively machining the axial surface of the connecting pads 35 of the inner case 34.

During the assembly procedure of the mid turbine frame portion 28, there provided are sub-assembly 28' including the outer case 30 and the radial spokes 36 attached thereto, and a sub-assembly 28" including the inner case 34 and bearing housing 50 concentrically attached thereto.

Figure 11:
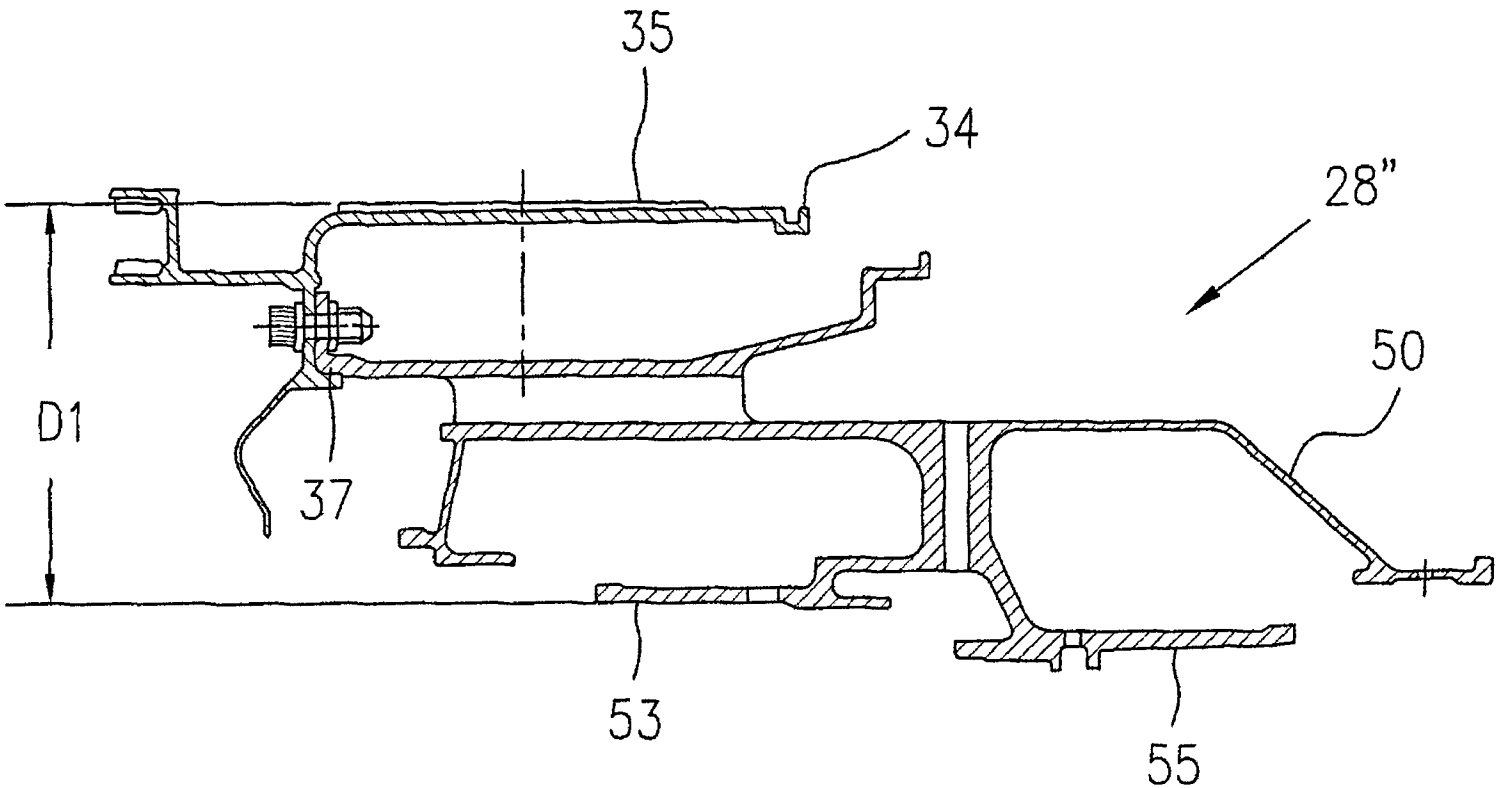
FIG. 11 is a cross-sectional view of a sub-assembly of the mid turbine frame of FIG. 9, showing the bearing housing attached to the inner case.

A radial distance D1 is defined between the respective axial surfaces of the connecting pads 35 of the inner case 34 and an inner diameter surface selected from one of the inner diameter surfaces 53, 55 (FIG. 11 shows inner diameter surface 53 being selected) of the bearing housing 50. Due to tolerance stack-up of the sub-assembly 28', D1 may be different when measured between the different axial surfaces of the connecting pads 35 of the inner case 34 and the inner diameter surface 53 and therefore, the various measurements of D1 relating to the respective axial surfaces of the connecting pads 35 are recorded.

Each of the inner ends, such as the inner end plate 52 of the respective spokes 36 is machined to suit the respective measurements of D1 relating to the corresponding axial surface of the connecting pads 35 which is to be connected with the particular spoke 36, thereby obtaining a predetermined radial distance D which is defined between the inner diameter surface 49 of the outer case 30 and the inner diameter surface 53 in accordance with the engine design.

Alternatively, a radial distance D2 is defined between the respective inner end, such as the inner end plate 52 in this case of the spokes and the inner diameter surface 49 of the outer case in the sub-assembly 28'. Due to the accuracy limit of the machining process of the spokes 36 and the assembly stack-up of the sub-assembly 28', different measurements of D2 may be taken relating to different spokes 36. The respective axial surfaces of connecting pads 35 of the inner case 34, may be selected to be machined to suit the respective measurements of D2, thereby obtaining the predetermined radial distance D as shown in FIG. 9.

After machining either the respective spokes 36 or the axial surfaces of connecting pads 35 of the inner case 34, the inner ends of the spokes 36 are connected to the axial surfaces of connecting pads 35 of the inner case 34, respectively, to assemble the sub-assemblies 28'and 28" together to form the MTF portion 28.

The ITD such as shown in FIG. 2 and indicated by numeral 110 may be added to the MTF portion 28 either before or after the machining process. It is understood that assembly and/or disassembly steps may vary from those described.

Optionally, the predetermined radial distance D is achieved as follows. The various measurements of D1 and D2 relating to the respective axial surfaces of the connecting pads 35 of the inner case 34 and the respective spokes 36 obtained in the respective sub-assemblies 28" and 28' are recorded. Paring the respective measurements of D1 and D2 according to the connection of the respective spokes 36 and the axial surfaces of the connecting pads 35 of the inner case 34 to calculate a material thickness Δ to be removed from either the spokes 36 or the axial surfaces of the connecting pads 35 of the inner case 34, respectively. The material thickness Δ calculated from the respective measurements of D1 and D2 in each link, is suit for the following equations: $(D1-\Delta)+D2=D$ or $(D2-\Delta)+D1=D$. It is understood that the sum of the radial distances D1 and D2 measured in any radial distance in which the spokes 36 extend, is greater than or at least equal to the predetermined radial distance D in order to provide the possibility for centering the bearing housing 50 by the described machining process.

Figure 10:
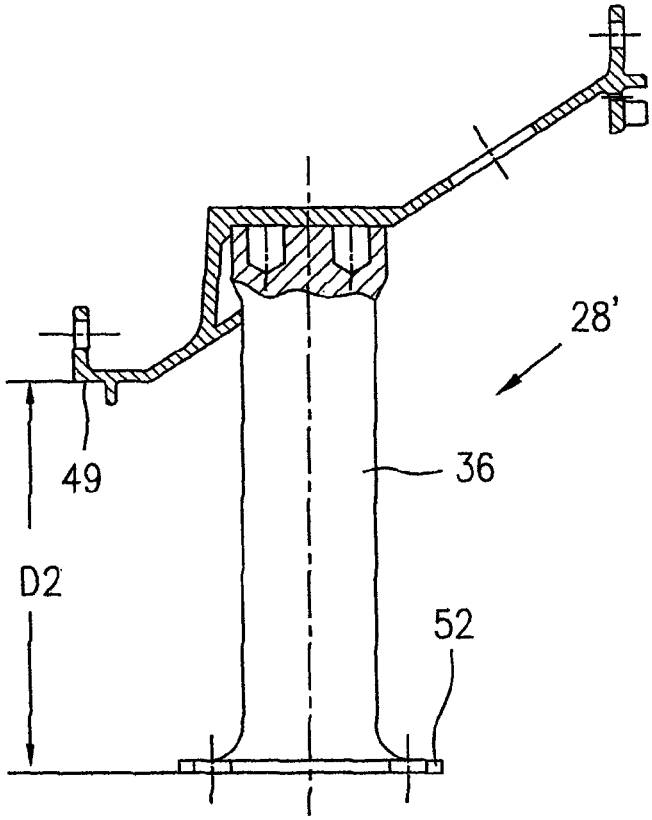
FIG. 10 is a cross-sectional view of a sub-assembly of the mid turbine frame of FIG. 9, showing the outer case with the spokes installed therein.
Figure 7:
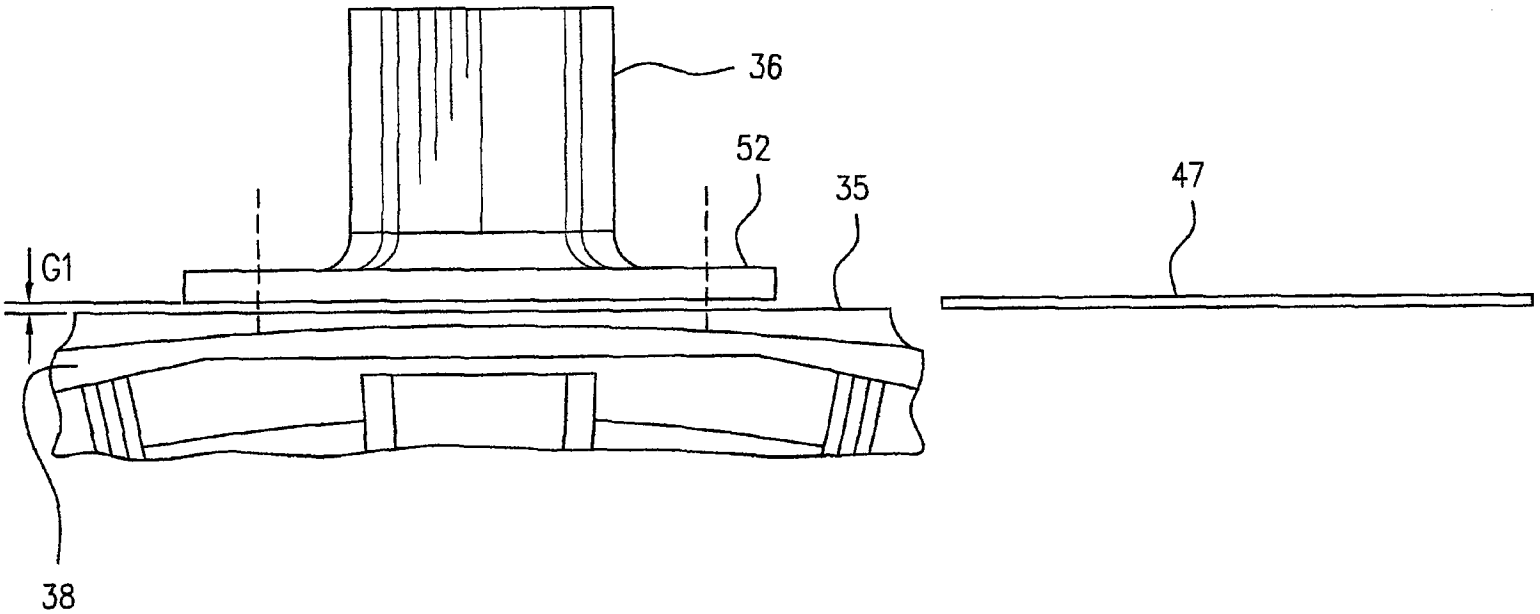
FIG. 7 is a partial rear-elevational view of the mid turbine frame of FIG. 2, showing a radial gap between a spoke and the inner case to be filled with a selected spacer.
Figure 8:
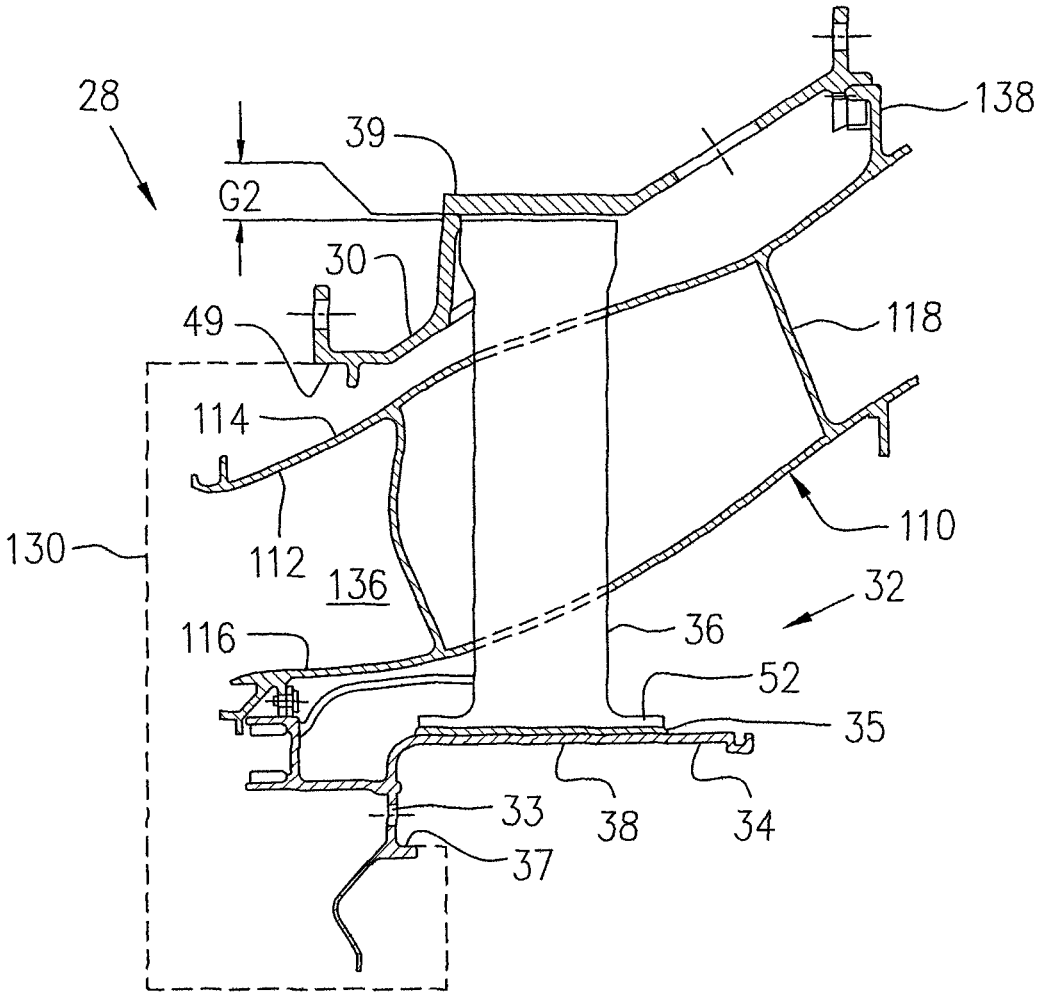
FIG. 8 is the mid turbine frame similar to that of FIG. 2, showing another method of completion of the mid turbine frame assembly procedure according to another embodiment.

Referring to FIG. 9, a further embodiment of the method for centering the bearing housing 50 is illustrated. According to this embodiment, the sub-assemblies 28' and 28" as shown in FIGS. 10 and 11 are assembled together to form the MTF portion 28 without the measuring and machining steps described in the previous embodiments. Therefore, the bearing housing 50 may not be concentric with the outer case 30 and the predetermined radial distance D may not be measured for example between the inner diameter surface 53 and the inner diameter surface 49 of the outer case 30. The MTF portion 28 is held on a fixture 132 as shown in broken lines which directly supports the inner diameter surface 53 of the bearing housing 50 to provide a machining position of the MTF portion 28. The inner diameter surface 49 of the outer case 30 is there machined in coordination with the contacting surfaces of the fixture 132, thereby obtaining the predetermined radial distance D between the inner diameter surface 49 of the outer case 30 and the inner diameter surface 53 of the bearing housing 50. Therefore, the bearing housing 50 is concentric with respect to the outer case 30 of the MTF portion 28.

Similarly, it is understood that the ITD as illustrated in FIG. 2 and indicated by numeral 110 may be added before or after the machining process. Additional or alternate assembly and/or disassembly steps may be desired.

In view of the above description, it will also be understood that these approaches may be used to establish and maintain any desired relative positioning of the inner and outer structures. For example, if a desired eccentricity (as opposed to concentricity) is desired, say to account for differential thermal growth in the structure at operating temperatures or to account for an corresponding eccentricity in rotor behaviour, then the above-described approaches may also be suitable in providing the desired relative positioning.

The above description is meant to be exemplary only, and one skilled in the art will recognize that changes may be made to the embodiments described without departure from the scope of the invention disclosed. For example, the approach may be applied to the centering of a bearing housing or other engine structure in any suitable engine case arrangement, and may be employed with any suitable bearing housing or other engine structure configuration. The approach may be applied to any suitable gas turbine engine configuration. Any suitable spoke and/or spacer configuration may be employed. Still other modifications which fall within the spirit of the present invention will be apparent to those skilled in the art, in light of the review of this disclosure, and such modifications are intended to fall within the scope of the appended claims.

The invention claimed is:

1. A method for positioning outer and inner cases of a gas turbine engine relative to one another, the outer and inner cases having a plurality of radial spokes extending between them when the outer and inner cases are assembled, a bearing housing being attached to the inner case, the method comprising:

a) positioning the inner and outer cases in a desired position;

b) determining a variance between a present radial spoke length and a desired radial spoke length for each radial spoke based on the desired positioning of the inner and outer cases, wherein eccentricity is measured between the outer case and the bearing housing on a fixture assembly;

c) abutting one end of each spoke against one of the inner and outer cases so that a radial gap exists between the other end of each radial spoke and the other of the inner and outer cases;

d) modifying an effective length of at least some of the radial spokes according to the variance in order to meet the desired radial spoke length and closing each radial gap by inserting at least one spacer into the radial gap; and e) securing the radial spokes, spacers and the inner and outer cases together to provide an engine case assembly having the desired positioning of the inner and outer cases.

2. The method as defined in claim 1 further comprising a step of placing the respective radial spokes into the outer case and connecting the respective radial spokes to the outer case prior to step (a), in order to ensure the direct contacting of the respective radial spokes with the outer case in step (c).

3. The method as defined in claim 1 further comprising a step of placing the respective radial spokes into the outer case prior to step (a), and a step of positioning the respective radial spokes in order to ensure the direct contacting of the respective radial spokes with the inner case in step (c).

4. The method as defined in claim 3 comprising a further step between steps (c) and (d), said further step including removing the inner case from the outer case to allow placing the respective selected spacers into the radial gaps between the respective radial spokes and the outer case.

5. The method as defined in claim 4 comprising a further step after step (e), said further step including connecting the respective spokes to the inner case when the respective spokes are in direct contact with the inner case.

6. The method as defined in claim 1 wherein two selected spacers are used per spoke when each radial gap is formed between non-parallel surfaces.

* * * * *